US005921681A

United States Patent [19]

Money

[11] Patent Number: 5,921,681

[45] Date of Patent: Jul. 13, 1999

[54] PACKS FOR ARTICLES OF MERCHANDISE

[75] Inventor: Julian David Kyrle Money, Richmond, United Kingdom

[73] Assignee: Pethick & Money Ltd., London, United Kingdom

[21] Appl. No.: 09/029,094

[22] PCT Filed: Aug. 9, 1996

[86] PCT No.: PCT/GB96/01941

§ 371 Date: Feb. 18, 1998

§ 102(e) Date: Feb. 18, 1998

[87] PCT Pub. No.: WO97/07037

PCT Pub. Date: Feb. 27, 1997

Related U.S. Application Data

[30] Foreign Application Priority Data

Aug. 18, 1995 [GB] United Kingdom ..... 9516991
Jun. 18, 1996 [GB] United Kingdom ..... 9612669

[51] Int. Cl.[6] ..... B65D 30/08; B65D 30/16; B65D 33/02

[52] U.S. Cl. ..... 383/119; 229/87.08; 229/117.03; 229/117.06; 229/117.32

[58] Field of Search ..... 383/119, 121.1; 229/938, 117.03, 117.06, 117.28, 117.32, 87.08, 904, 906

[56] References Cited

U.S. PATENT DOCUMENTS

| | | | |
|---|---|---|---|
| 2,282,207 | 5/1942 | Palmer | 383/119 |
| 2,342,439 | 2/1944 | Waters | 229/117.06 |
| 2,412,547 | 12/1946 | Waters | 229/117.06 |
| 2,432,052 | 12/1947 | Waters | 229/117.06 |
| 3,074,617 | 1/1963 | Kindseth et al. | 383/119 |
| 3,195,803 | 7/1965 | Ford | 229/87.08 |
| 3,399,818 | 9/1968 | Stegner | 229/117.32 |
| 3,630,430 | 12/1971 | Struble | 229/117.03 |
| 4,267,955 | 5/1981 | Struble | 229/117.03 |
| 4,723,700 | 2/1988 | Wischusen, III | 229/87.08 |
| 4,754,914 | 7/1988 | Wischusen. III | 229/87.08 |
| 5,028,147 | 7/1991 | Graham | 229/117.06 |

FOREIGN PATENT DOCUMENTS

| | | |
|---|---|---|
| 1 188 389 | 9/1959 | France . |
| 1 339 852 | 1/1964 | France . |
| 1 535 316 | 6/1968 | France . |
| 2 110 568 | 6/1972 | France . |
| 2 087 357 | 5/1982 | United Kingdom . |

OTHER PUBLICATIONS

International Search Report.

*Primary Examiner*—Stephen P. Garbe
*Attorney, Agent, or Firm*—Fish & Richardson P.C.

[57] ABSTRACT

The disclosure relates to a pack for articles of food or other merchandise comprising a bag (30) and a carton form (40) for supporting a lower part of the bag having a base (41) with a central fold line (32) and walls (43) hinged to the base along further fold lines (44) to enable the carton and bag to be folded flat and to be erected to open the bag. The side walls of the lower part of the bag are secured to the side walls of the carton so that when the carton is erected by opening the folded base into a V-form, the bottom part of the bag is opened, and, as the V-form is progressively widened, the bag is tensioned by the walls moving apart until the base of the carton moves "over center" and inverts to brace the lower part of the bag open to receive an article or articles to be packed therein.

10 Claims, 9 Drawing Sheets

PAPER SIZE
PAPER CUTTER
CARTON CUTTER
GLUE
GLUE
GLUE
GLUE
GLUE
GLUE
GLUE
GLUE
10
11
12
13
14
15
16
17
18
19
20
21
22

FIG. 10.
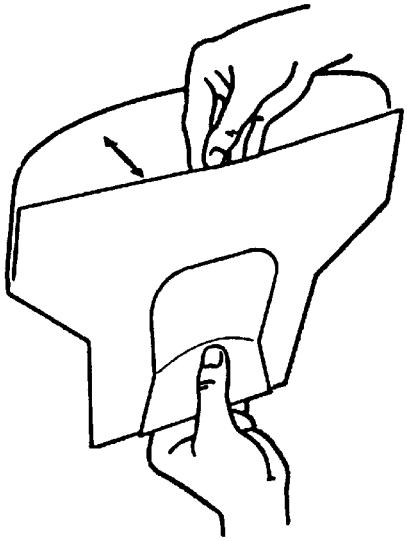
FIG. 11.
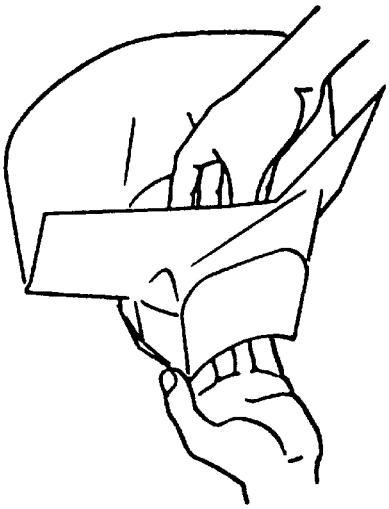
FIG. 12.
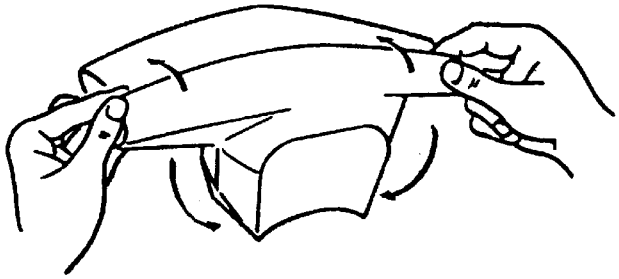
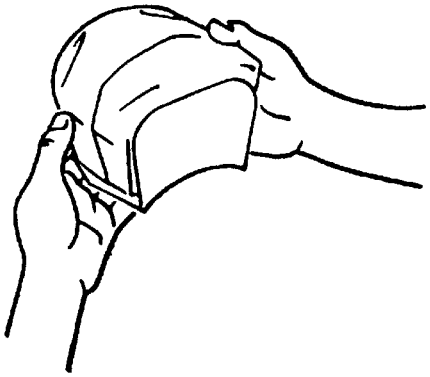
FIG. 13.

PACKS FOR ARTICLES OF MERCHANDISE

This invention relates to a pack for articles of merchandise such as "fast-food" products including burgers, fish pieces, chicken pieces and french fries, or other food items including confectioners, bakery products or gift items.

FR-A-1,339.852 discloses a package comprising a continuous strip of rigid packaging material, for example of cardboard, which envelopes a bag or sachet. The strip is divided by folding lines into two side panels separated by folding lines from bottom rectangles. The bottom rectangles are folded between one another by a folding line enabling the strip to be flattened and the bag to be sandwiched for stacking and storage.

GB-A-2087357 discloses a collapsible container e.g. for a food product such as chipped potatoes includes front and back walls which at their mutually adjacent edges are hinged on bowed hinge lines to a foldable bottom for the container. At their side edges the front and back walls are connected to side wall forming panels by further bowed hinge lines, these panels being secured in overlapping relationship. The bowed hinge lines of the bottom and side walls co-operate with associated median fold lines of those walls to hold the carton erected and capable of standing upright.

It is an object of the invention to provide a pack for food or the like in which the base of the pack is positively held erect.

This invention provides a pack for articles of food or other merchandise comprising a paper or film bag and a carton form for supporting a lower part of the bag having a base with a central fold line and walls hinged to the base along further fold lines to enable the carton and bag to be folded flat and to be erected to open the bag, the side walls of said lower part of the bag being secured to the side walls of the carton so that when the carton is erected by opening the folded base into a V-form the bottom part of the bag is opened, and, as the V-form is progressively widened, is tensioned as the walls move apart until the base of the carton moves "over centre" and inverts to hold the lower part of the bag open to receive an article or articles to be packed therein, wherein ends of the base are of projecting V-shaped form and said further fold lines between the side walls and bottom of the carton are convexly curved so that on inverting the base of the carton goes "over centre" and assumes a concavely curved form with the side walls of the carton bowed or convexly curved whereby the base of the carton is braced open against the bottom part of the bag held open in tension.

Generally the sides of the bag may be bonded to the walls of the carton.

More specifically, the sides of the bag may be adhered to the walls of the carton.

In one particular embodiment of the invention the carton may comprise side walls and end walls and a bottom wall bridging the side walls but not connected to the end walls.

In the latter arrangement the end walls of the carton may be shorter than the side walls of the carton so that when the carton is unfolded, the bottom wall of the carton forms a V-formation which can be snapped into an inverted V which holds the side walls apart with the end walls straight to receive an article in the container.

More specifically, the carton may be located within the bag.

In alternative arrangements the bag may be located within the carton with the sides of the bag secured to the inside faces of the side walls of the carton.

In the latter arrangement, the mouth part of the bag may be folded to form outwardly extending wing portions which can be folded around the article between the side walls and tucked between the bottom wall of the bag and base of the carton to hold the bag closed.

The following is a description of some specific embodiments of the invention, reference being made to the accompanying drawings in which;

FIGS. 10 to 13 illustrate the progressive opening of the pack from flat form to fully erected and filled pack.

Figure 1:
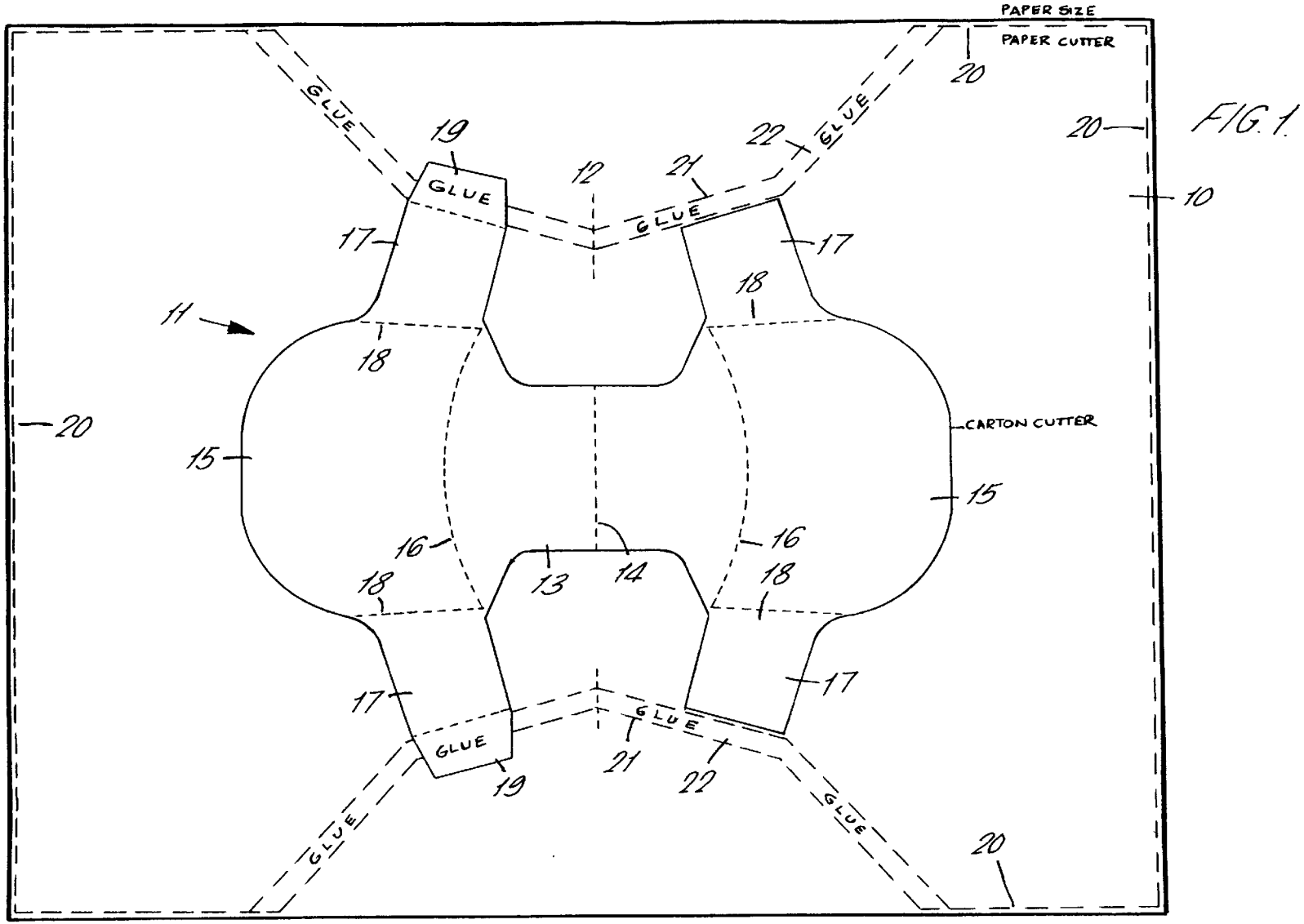
FIG. 1 is a plan view of a blank sheet of paper with a superimposed carton blank of material for a carton from which a pack for a burger or other article is formed.

Referring firstly to FIG. 1 of the drawings, there is shown a rectangular sheet of giftwrap paper 10 to which a blank 11 of material for an open-topped carton is laminated, the blank being positioned symmetrically on either side of a centre line 12 on the sheet about which the sheet is folded as described later.

The cardboard blank comprises a bottom wall 13 having a pre-creased centre line 14 located in line with the centre line 12 of the sheet 10. Side walls 15 are connected to the outer edges of the bottom wall along curved pre-creased lines 16. Each side wall 15 has end wall portions 17 with pre-creased lines 18 between the end wall portions and respective side walls. The end wall portions 17 on one of the side walls 15 have extended glue tabs 19 to be bonded to the end wall portions of the side wall.

Sheet 10 is cut along the dotted outline 20 which includes recesses 21 cut in either side of the sheet and bands 22 of adhesive are applied to the sheet around the edges of the recesses and to the glue tabs 19 of the end portions of the carton. Alternatively the sheet may be formed from a heat-sealable film material to be adhered together by application of heat and pressure along the bands and other areas indicated.

Figure 2:
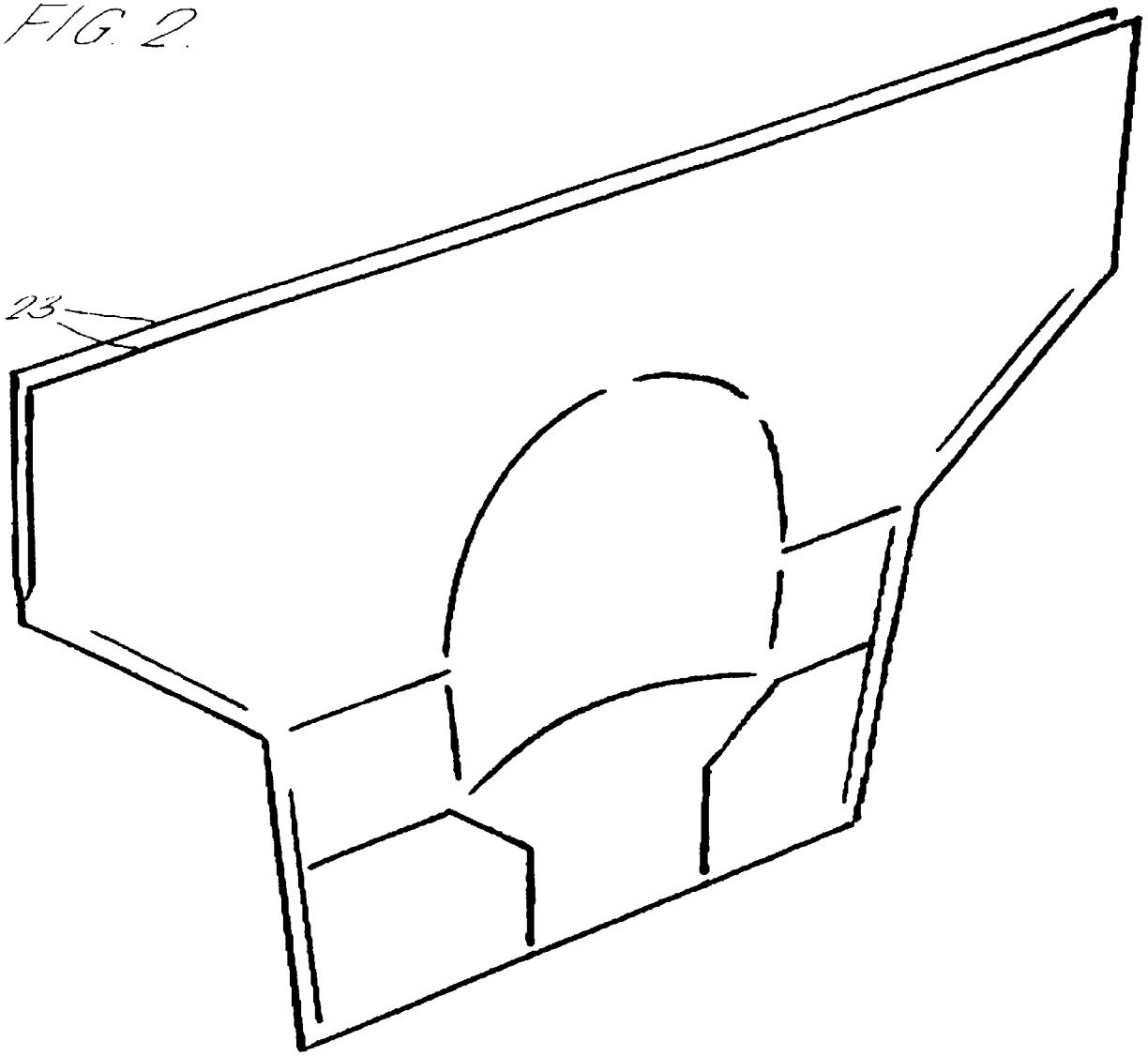
FIG. 2 is a perspective view of the completed folded pack in flat condition.
Figure 3:
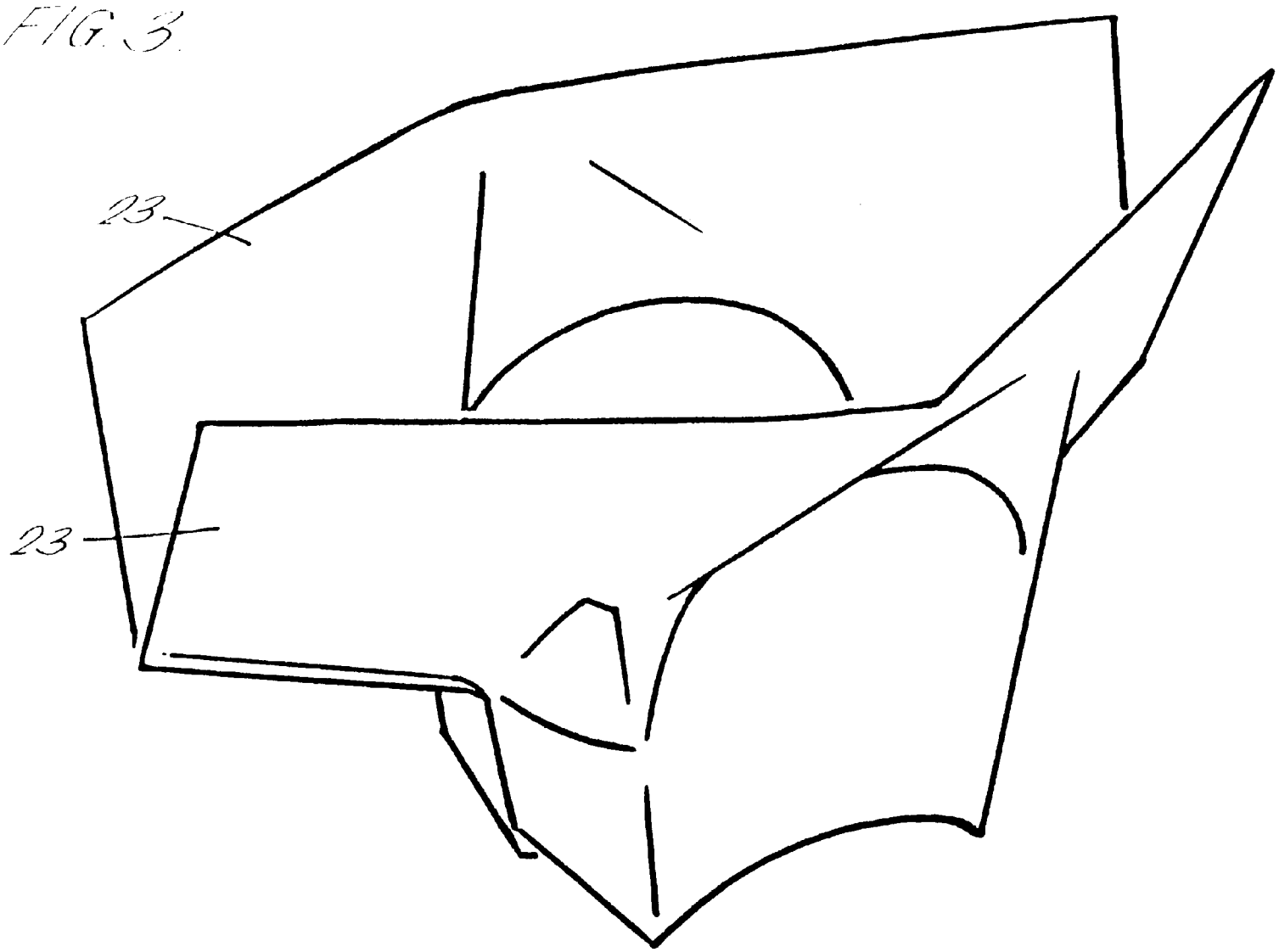
FIG. 3 is a perspective view of the pack erected and open to receive an article to be wrapped.

The sheet 10 is folded about the centre line 12 as indicated earlier to adhere or heat seal the edges of each recess 21 on either side of the centre line to each other and to adhere or heat seal the tabs 19 on the end portions of one of the side walls 15 to the end portions of the other side wall to form a folded blank as illustrated in FIG. 2. The end portions 23 of the sheet are separated to open the blank as illustrated in FIG. 3. The folded blank of carton material within the folded sheet can then be opened by separating the side walls 15 and pressing the centre of the folded base 13 upwardly towards the side walls. The length of the part of the blank forming the base 13 is greater than the length of the end walls 17 so that the base 13 forms a V-formation between the side walls when the end walls are held straight between the side walls. The V-shaped base can then be pressed "over centre" between the side walls into an inverted V-formation to hold the side walls apart. The blank then forms an open-topped carton within the sheet 10 ready to receive an item of merchandise such as a burger or other article.

Figure 4:
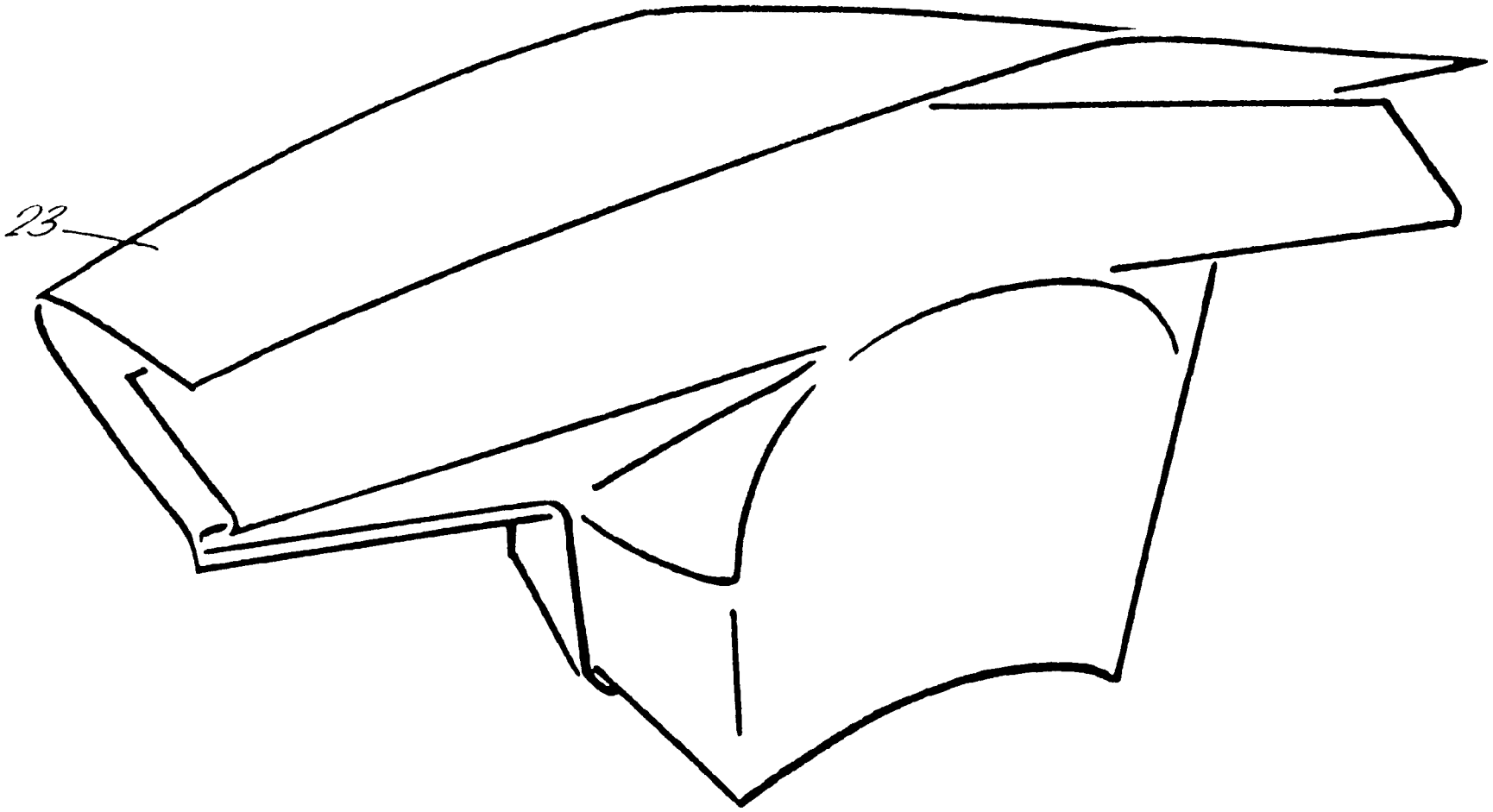
FIG. 4 is a perspective view of the pack after insertion of an article in the pack with the pack partially closed.
Figure 5:
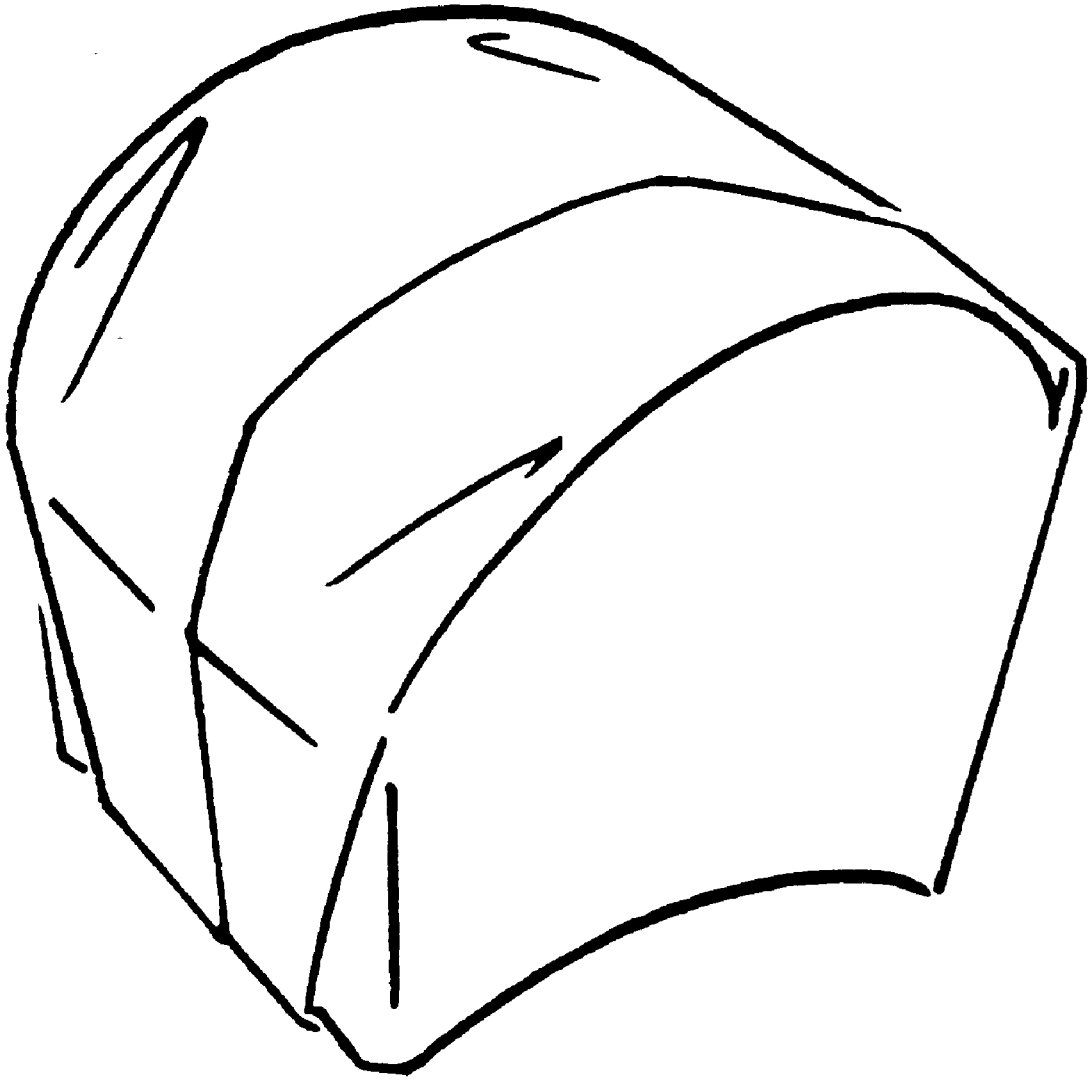
FIG. 5 is a perspective view of the pack fully closed.

Having inserted the article in the carton, the end portions of the sheet 23 are folded together as illustrated in FIG. 4 to close the top of the carton and are tucked underneath the bottom of the carton as illustrated in FIG. 5 to complete the pack. It will be noted that upper edges of the side walls 15 are curved or curvilinear to provide a curved profile to the top of the pack and the curved fold lines 16 between the bottom edges of the side walls and the base of the carton form a curved bottom to the carton.

The sheet with its laminated inner carton forms a flexible pack which can be supplied in flat form and effectively becomes a semi-rigid container to receive and hold an article to be merchandised. In the case of the food item such as a burger, the pack forms a convenient device for holding the burger whilst it is being consumed.

Figure 6:
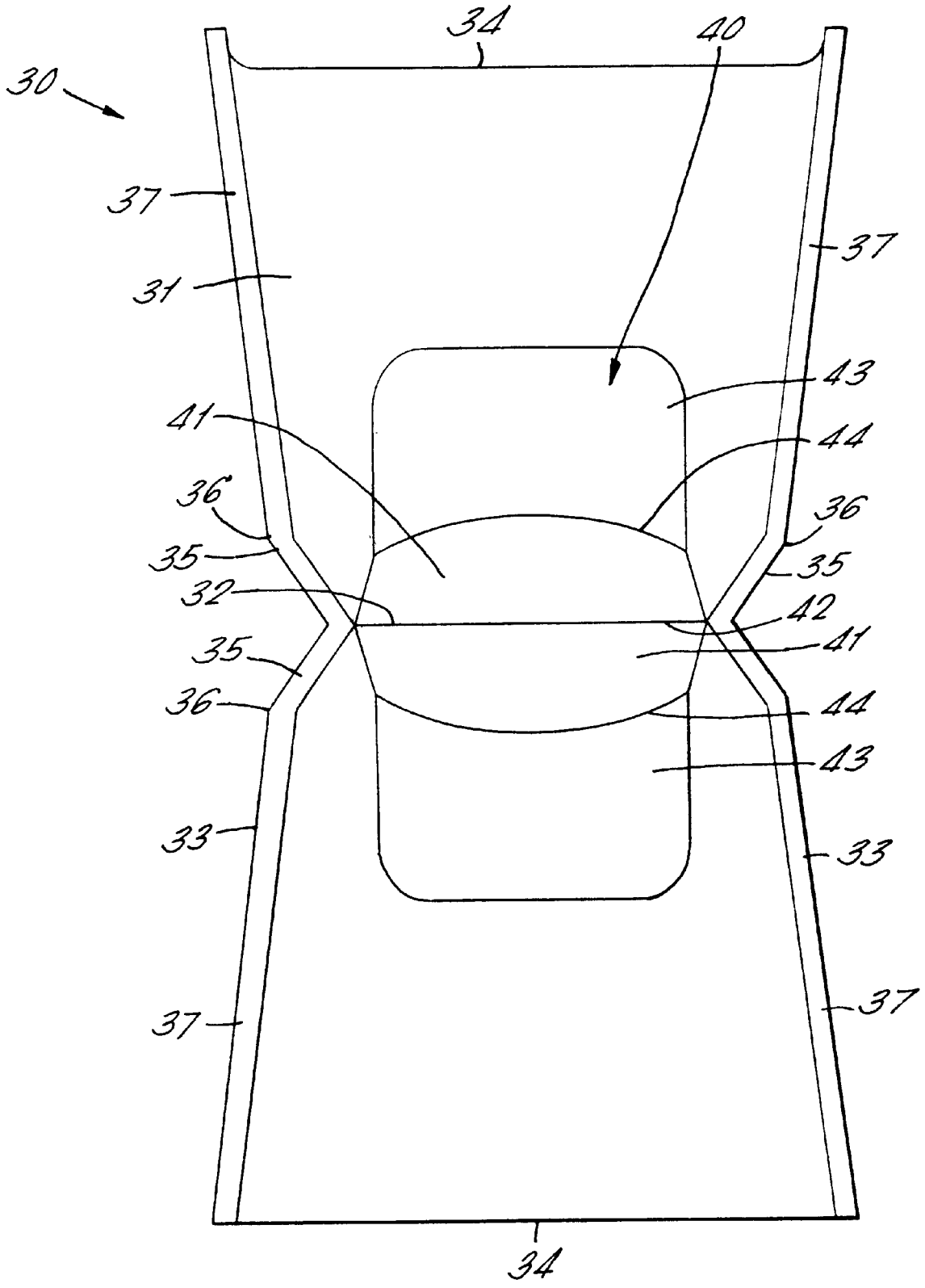
FIG. 6 is a plan view of a blank for a paper bag to receive an article of merchandise having a lower part supported by a carton form.

Referring now to FIG. 6 of the drawings, there is shown a blank indicated generally at 30 for a pack to receive articles of food or merchandise. In this case the bag is particularly intended for holding a supply of "french fries" confectionery or other snack products such as crisps, nuts, popcorn etc. for consumption.

The blank comprises two walls 31 connected together at a fold line 32 and cut to provide side edges 33 and top edges 34 with "profiled" to create the required bag shape. Immediately adjacent the fold line 32, the walls diverge sharply as indicated at 35 to a point 36 to form the bottom wall of the bag and after which they diverge at a shallow angles to define the side walls of the bag. The walls of the bag are heat sealed or otherwise adhered together along bands indicated at 37 to form the bag leaving the top edges 34 unattached to provide an opening into the bag through which the articles of food or other merchandise are inserted into the bag.

A cardboard carton form indicated generally at 40 is secured to the side of the paper blank which is to form the outer face of the bag. The blank comprises a base 41 extending across the blank and having a central fold line 42 coincident with the bottom fold 32 of the paper blank. The base has side walls 43 connected to it along further fold lines 44 which are convexly curved, as can be seen in FIG. 6, for a purpose described below. The side walls 43 are secured by heat sealing or adhesive to the sides of the bag.

Figure 7:
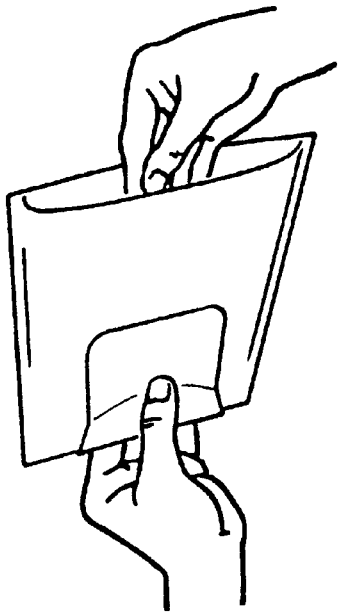
FIG. 7 is a perspective view of a completed pack of the form shown in FIG. 6 in flattened condition ready for erection.

FIG. 7 of the drawings shows the completed bag/carton form with the side edges of the bag adhered together as described above and in generally flat form prior to filling.

Figure 8:
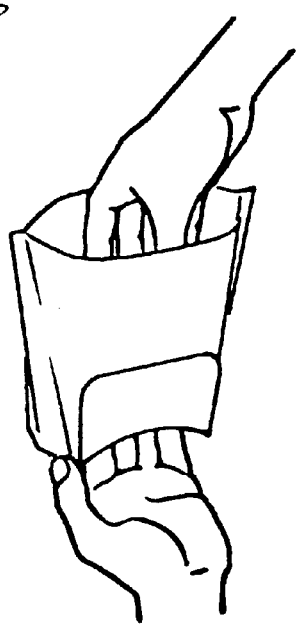
FIG. 8 is a perspective view of the pack opened ready to receive an article of merchandise.

The top or mouth of the bag is opened to receive an article and the lower portion held open as shown in FIG. 8 by erecting the carton as follows. The sides 31 of the bag are spread open by inserting a filling device, e.g. a chip scoop or by pulling down on the top edges of the carton from the sides and pushing up the base 42. Otherwise the top can be opened by inserting the fingers of a hand into top of the bag. At this stage the bottom of the carton is in a generally V-formation. By pressing the fold line 32 of the carton between the side walls of the carton the V-form is gradually widened, tensioning the bottom part of the bag between the side walls until it inverts and goes "over centre". The bottom of the carton inverts to a concave shape as a result of the corner fold lines 44 and the side walls of the carton have converse curvature. The carton is then self supporting and holds the bottom of the bag open ready to receive a supply of "french fries" or other food or articles of merchandise.

Figure 9:
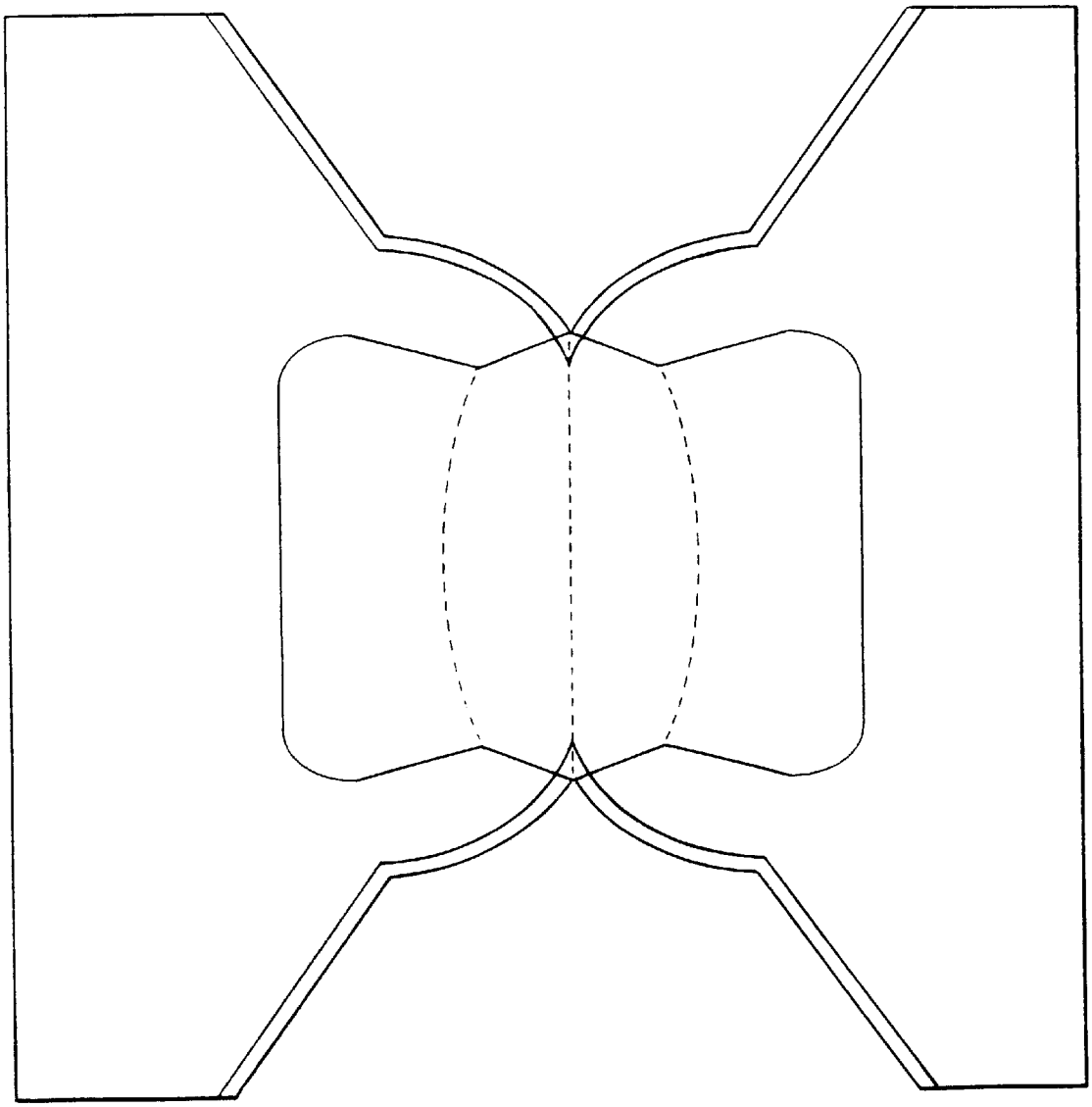
FIG. 9 is a plan view of a blank for a further form of pack.

FIG. 9 of the drawings shows a slightly different bag form in which the edges of the side walls of the bag nearest the fold line at its bottom are convexly curved to give a generally circular shape to the bottom of the bag. Above the convexly curved edges the side walls flair upwardly and outwardly, as indicated at 45, to end in wide top flaps 46. The edges of the side walls are secured together by heat sealing or adhesive along the band lines 47 indicated.

Reference is now made to FIGS. 10 to 13 which illustrate the opening direction of the bag and filling of the bag.

The bag is particularly suitable for a item of food such as a burger. The burger is placed in the lower portion of the bag supported by the carton and the top flaps of the bag are then folded together over the burger and the resulting wing portions are folded downwardly and tucked into the gap between the bottom of the bag and base of the carton form to hold the bag closed to protect the burger or other food item enclosed in the bag.

It would be appreciated that many modifications may be made to the above described embodiments without departing from the scope of the invention.

For example, the bag may be formed with deep gussets along either side to provide a wider opening where required. The top edges of the bag can be provided with a closure such as a self adhesive strip, heat seal or can be simply folded together to close the top of the bag to provide a tamper evident closure. Further, the fold lines of the cardboard carton forms could be perforated for ease of pre-creasing to facilitate erection of the carton form.

I claim:

1. A pack for articles of food or other merchandise comprising a paper or film bag and a carton form for supporting a lower part of the bag, said carton form having a base with a central fold line and side walls hinged to the base along further fold lines to enable the carton form and bag to be folded flat and to be erected to open the bag, side walls of a lower part of the bag being secured to the side walls of the carton form so that when the carton form is erected by opening the folded base into a V-form, the bottom part of the bag is opened, characterized in that the bottom part of the bag is progressively widened as the V-form is progressively widened and the side walls of the carton form move apart until the base of the carton form moves "over center" and inverts and characterized in that ends of the base of the carton form are of projecting V-shape form, and the said further fold lines between the side walls and bottom of the carton form are convexly curved so that, on inverting, the base of the carton form assumes a concavely curved form with the side walls of the carton form bowed or convexly curved, whereby the base of the carton form is braced open against the bottom part of the bag which is held open in tension.

2. A pack as claimed in claim 1 characterized in that the sides of the bag are bonded to the side walls of the carton.

3. A pack as claimed in claim 2, characterized in that the sides of the bag are adhered to the side walls of the carton.

4. A pack as claimed in any of the preceding claims, characterized in that the carton form comprises side walls and end walls and a bottom wall bridging the side walls but not connected to the end walls.

5. A pack as claimed in claim 4, characterized in that the end walls of the carton form are shorter than the side walls of the carton form so that when the carton form is unfolded, the bottom wall of the carton form forms a V-formation which can be snapped with the end walls straight to receive an article in the container.

6. A pack as claimed in claim 1, 2 or 3, characterized in that the carton form is located within the bag.

7. A pack as claimed in claim 1, 2 or 3, characterized in that the bag is located within the carton form with the sides walls of the bag secured to inside faces of the side walls of the carton form.

8. A pack as claimed in claim 7, characterized in that a mouth part of the bag can be folded to form outwardly extending wing portions to fold around the article between the side walls and tucked between the bottom wall of the bag and base of the carton form to hold the bag closed.

9. A pack as claimed in claim 4, characterized in that the carton form is located within the bag.

10. A pack as claimed in claim 5, characterized in that the carton form is located (with) within the bag.

* * * * *